United States Patent [19]

Nakamura et al.

[11] 4,343,886

[45] Aug. 10, 1982

[54] METHOD FOR STABILIZING DYE IMAGES IN COLOR PHOTOGRAPHIC SENSITIVE MATERIALS USING A LIGAND AS A DYE IMAGE STABILIZER PRECURSOR IN COMBINATION WITH METAL IONS

[75] Inventors: Kotaro Nakamura; Seiiti Kubodera; Satoru Sawada; Hiroshi Hara; Yoshiaki Suzuki; Shigeru Oono, all of Minami-ashigara, Japan

[73] Assignee: Fuji Photo Film Co., Ltd., Kanagawa, Japan

[21] Appl. No.: 198,026

[22] Filed: Oct. 17, 1980

[30] Foreign Application Priority Data

Oct. 18, 1979 [JP] Japan ..... 54-134433

[51] Int. Cl.[3] ..... G03C 1/40; G03C 7/00; G03C 1/84; G03C 1/10

[52] U.S. Cl. ..... 430/237; 430/216; 430/372; 430/551; 430/559

[58] Field of Search ..... 430/237, 216, 372, 551, 430/559, 542, 564

[56] References Cited

U.S. PATENT DOCUMENTS 4,245,018 1/1981 Hara ..... 430/14

*Primary Examiner*—John E. Kittle
*Assistant Examiner*—John L. Goodrow
*Attorney, Agent, or Firm*—Sughrue, Mion, Zinn, Macpeak & Seas

[57] ABSTRACT

A dye image stabilization process for color photographic sensitive elements which comprises processing a color photographic sensitive element containing at least one dye image stabilizer precursor with a solution containing divalent ions of at least one metal selected from Cu, Co, Ni, Pd and Pt is disclosed. Light fastness of dye images is thus improved.

26 Claims, No Drawings

METHOD FOR STABILIZING DYE IMAGES IN COLOR PHOTOGRAPHIC SENSITIVE MATERIALS USING A LIGAND AS A DYE IMAGE STABILIZER PRECURSOR IN COMBINATION WITH METAL IONS

BACKGROUND OF THE INVENTION

1. Field of the Invention

The present invention relates to a dye image stabilization process for color photographic sensitive materials and particularly to a process for improving light fastness of dye images of color photographic sensitive materials.

2. Description of the Prior Art

In color photographic sensitive materials utilizing photosensitive silver halide, dye images are formed by the reaction of a color coupler with an oxidation product of a color developing agent, the reaction of a DDR coupler with an oxidation product of a color developing agent, oxidation of a dye developing agent, and bleaching dyes using development silver as a catalyst. However, the dyes or dye images (referred to as dye image, hereinafter) formed in such a manner fade or discolor due to the action of light like the case of dyes for conventional use, though the degree of fading or discoloration differs in each case.

Hitherto, various attempts have been made to prevent fading or discoloring of the above-described dye image caused by light (namely, to improve the light fastness of the dye image). However, a process having a sufficient effect has not been found.

For example, it has been known to use hydroquinone derivatives such as described in U.S. Pat. Nos. 2,360,290, 2,418,613, 2,675,314, 2,701,197, 2,704,713, 2,728,659, 2,732,300, 2,735,765, 2,710,801 and 2,816,028 and British Patent 1,363,921; gasslic acid derivatives such as described in U.S. Pat. Nos. 3,457,079 and 3,069,262 and Japanese Patent Publication No. 13496/68; p-alkoxyphenols such as described in U.S. Pat. Nos. 2,735,765 and 3,698,909; and chroman and coumaran derivatives such as described in U.S. Pat. Nos. 3,432,300, 3,573,050, 3,574,627, 3,764,337, 3,574,626, 3,698,909 and 4,015,990, etc., to prevent dye image fading. However, it cannot be said that these agents adequately prevent fading or discoloring of dye images.

Further, a process by which the stability of the dye images to light is improved using azomethine quenching compounds the absorption maximum of which is deeper than the absorption maximum of the dye forming the dye image has been described in British Pat. No. 1,451,000. However, this process is disadvantageous because the azomethine compound itself is intensely colored and the hue of the dye image is highly affected thereby.

In addition, a process has been known which comprises adding certain metal complexes to a color photographic sensitive material by which dye images formed thereafter are stabilized to light, as described in, for example, Japanese Patent Application (OPI) No. 87649/75 (the term "OPI" as used herein refers to a "published unexamined Japanese patent application") (U.S. Pat. No. 4,050,938) and *Research Disclosure,* 15162 (1976). However, metal complexes of this kind have problems in practical use as will be later discussed in Example 3 because:

(1) Not only do they not have so high an effect in preventing fading, but they also are difficult to add in adequate amounts to prevent fading because of their low solubility in the solvents commonly used for photographic additives.

(2) The hue and the purity of the dye images are adversely affected when the comples is added in a large amount, because the complex itself is intensely colored.

(3) Preparation of the photosensitive material is difficult, because the metal as a central atom of the complex has an unusually bad influence upon photographic properties.

(4) The fade preventing effect is reduced during processing steps such as development, etc., because the metal complex is subjected to modification.

U.S. Pat. No. 3,762,922 describes a process for improving light fastness which comprises carrying out development of a black-white photographic sensitive material containing a black coupler to couple it with an oxidation product of a color developing agent, and processing with a liquid containing heavy metal ions such as Cu, Co, Ni, Cd, Zn or Ag, etc., to form a chelate of the black dye formed by the above-described coupling. This process is different from the present invention in construction and effect, because the ligand forming the chelate with the metal ions is the dye itself and, consequently, the process can only be applied to black dye images.

In order to obviate these disadvantages of the prior art, the present inventors previously proposed a method for stabilizing organic substrate materials (e.g., dyes) to the action of light by making metal complexes having the following skeletal structure:

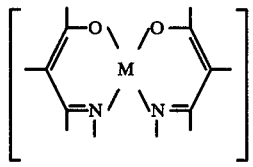

wherein M represents Cu, Co, Ni, Pd or Pt; coexisting with the organic substrate materials (U.S. Patent Ser. No. 56,674, filed July 11, 1979) now U.S. Pat. No. 4,245,018. The metal complexes are excellent color fade preventing agents due to excellent solubility in an organic solvent and minimizing to worsen color hue or purity of color images.

SUMMARY OF THE INVENTION

An object of the present invention is to provide a process for stabilizing dye images of color photographic sensitive materials to light.

Another object of the present invention is to provide a process for stabilizing dye images of color photographic sensitive materials to light without changing the hue and the purity of the dye images.

A further object of the present invention is to provide a process of improving the stability to light of dye images using a dye image stabilizer precursor which has high solubility to organic solvents and high compatibility with substances composing the dye image.

A further object of the present invention is to provide a process for stabilizing dye images to light without interfering with the photographic properties of color photographic sensitive materials.

The present invention relates to an improvement of such a method by separately providing a ligand as a dye image stabilizer precursor and metal ions, instead of providing the metal complex, to form the same metal complex during processing. Such a separate provision of the metal complex (as is described below in detail) results in advantages that:

(1) procedures for previously preparing metal complexes are unnecessary;

(2) ligands can be incorporated into photographic elements in a larger amount than that incorporated as complex thereof;

(3) it is easier to design or prepare color photographic elements since it is unnecessary to take any possible influence of metal ions on photographic properties into consideration; and (4) any chances that metal complexes might be decomposed during storage of unexposed light sensitive materials or during processing are not encountered with such a separate provision.

Above-described objects have been attained by processing a color photographic sensitive material containing at least one compound selected from those represented by the following formulae (I), (II), (III) and (IV) and the alkali metal salts, alkaline earth metal salts, borates, aluminium salts and zinc salts thereof with a solution containing divalent ions of at least one metal selected from the group consisting of copper, cobalt, nickel, palladium and platinum.

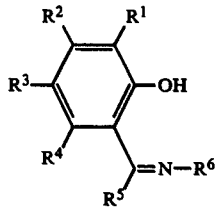
(I)

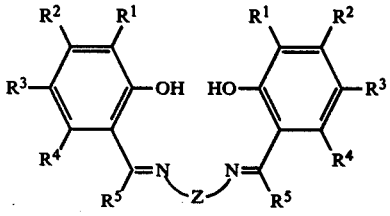
(II)

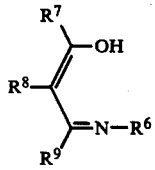
(III)

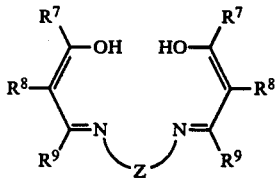
(IV)

Formulae (III) and (IV) above are interpreted as including the tautomers.

In the formulae, $R^1$, $R^2$, $R^3$ and $R^4$ each represents a hydrogen atom, a halogen atom, a cyano group or an alkyl group, an aryl group, a cycloalkyl group or a heterocyclic group bonded to the benzene nucleus directly or through a divalent connecting group, or $R^1$ and $R^2$, $R^2$ and $R^3$ or $R^3$ and $R^4$ combine to represent the non-metallic atomic group necessary to form a 6-member aromatic and aliphatic ring (e.g., cyclohexyl).

$R^5$, $R^8$ and $R^9$ each represents a hydrogen atom, an alkyl group or an aryl group, $R^6$ represents a hydrogen atom, an alkyl group, an aryl group or a hydroxyl group, $R^7$ represents an alkyl group or an aryl group, or $R^7$ and $R^8$ or $R^8$ and $R^9$ may combine to represent the non-metallic atoms necessary to form a 5-member to 8-member aliphatic ring.

Z represents a divalent connecting group consisting of non-metallic atoms.

DETAILED DESCRIPTION OF THE INVENTION

The compounds represented by the above-described general formulae (I), (II), (III) and (IV) and the alkali metal salts (for example, the Li salts, Na salts and K salts, etc.), alkaline earth metal salts (for example, Mg salts and Ca salts), borates, aluminium salts and zinc salts (hereafter referred to as the "dye image stabilizer precursor") come to function to improve dye image stability upon processing with a solution containing the divalent ions of metal selected from copper, cobalt, nickel, palladium and platinum and are illustrated in greater detail below.

In the general formulae (I) and (II), the halogen atom represented by $R^1$, $R^2$, $R^3$ and $R^4$ may be a fluorine atom, a chlorine atom, a bromine atom or an iodine atom.

The alkyl groups represented by $R^1$, $R^2$, $R^3$ and $R^4$ are preferably alkyl groups having 1 to 19 carbon atoms, which may be straight chain, branched chain and substituted or unsubstituted. The aryl groups represented by $R^1$, $R^2$, $R^3$ and $R^4$ are preferably aryl groups having 6 to 14 carbon atoms, which may be substituted or unsubstituted. The heterocyclic groups represented by $R^1$, $R^2$, $R^3$ and $R^4$ are preferably 5-member rings and 6-member rings, which may be substituted or unsubstituted. The cycloalkyl groups represented by $R^1$, $R^2$, $R^3$ and $R^4$ are preferably 5-member rings and 6-member rings which may be substituted or unsubstituted.

The 6-member aromatic or aliphatic ring formed by linking $R^1$ and $R^2$, $R^2$ and $R^3$ or $R^3$ and $R^4$ is preferably a benzene ring, which may be substituted or unsubstituted, or a condensed benzene ring (e.g., naphthalene, tetrahydronaphthalene).

Examples of the straight chain or branched chain alkyl groups represented by $R^1$, $R^2$, $R^3$ and $R^4$ include a methyl group, an ethyl group, a propyl group, a butyl group, a hexyl group, an octyl group, a decyl group, a dodecyl group, a tetradecyl group, a hexadecyl group and an octadecyl group.

Examples of the aryl groups represented by $R^1$, $R^2$, $R^3$ and $R^4$ include a phenyl group and a naphthyl group.

The heterocyclic groups represented by $R^1$, $R^2$, $R^3$ and $R^4$ are 5-member and 6-member heterocyclic groups containing as hetero atoms at least a nitrogen atom, an oxygen atom or a sulfur atom in the ring, examples of which include a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group and a thiazolyl group, etc.

Examples of the cycloalkyl groups represented by $R^1$, $R^2$, $R^3$ and $R^4$ include a cyclopentyl group and a cyclohexyl group, etc.

Examples of the 6-member ring formed by combining $R^1$ and $R^2$, $R^2$ and $R^3$ or $R^3$ and $R^4$ include a benzene ring, a naphthalene ring, an isobenzothiophene ring, an isobenzofuran ring and an isoindoline ring, etc.

The alkyl groups, cycloalkyl groups, aryl groups or heterocyclic groups represented by $R^1$, $R^2$, $R^3$ and $R^4$ described in the above may be bonded to a carbon atom on the benzene ring through a divalent connecting group such as an oxy group (—O—), a thio group (—S—), an amino group, an oxycarbonyl group, a carbonyl group, a carbamoyl group, a sulfamoyl group, a carbonylamino group, a sulfonyl group or a carbonyloxy group, etc.

Examples of the alkyl groups represented by $R^1$, $R^2$, $R^3$ and $R^4$ which are bonded to a carbon atom on the benzene ring through one of the above-described divalent connecting group include alkoxy group (for example, a methoxy group, an ethoxy group, a butoxy group, a propoxy group, an n-decyloxy group, an n-dodecyloxy group and an n-hexadecyloxy group, etc.), alkoxycarbonyl groups (for example, a methoxycarbonyl group, an ethoxycarbonyl group, a butoxycarbonyl group, an n-decyloxycarbonyl group and an n-hexadecyloxycarbonyl group, etc.), acyl groups (for example, an acetyl group, a valeryl group, a stearoyl group, a benzoyl group and a toluoyl group, etc.), acyloxy groups (for example, an acetoxy group and a hexadecylcarbonyloxy group, etc.), alkylamino groups (for example, an n-butylamino group, an N,N-diethylamino group and an N,N-didecylamino group, etc.), alkylcarbamoyl groups (for example, a butylcarbamoyl group, an N,N-diethylcarbamoyl group and an n-dodecylcarbamoyl group, etc.), alkylsulfamoyl groups (for example, a butylsulfamoyl group, an N,N-diethylsulfamoyl group and an n-dodecylsulfamoyl group, etc.), sulfonylamino groups (for example, a methylsulfonylamino group and a butylsulfonylamino group, etc.), sulfonyl groups (for example, a mesyl group, and an ethanesulfonyl group, etc.) and acylamino groups (for example, an acetylamino group, a valerylamino group, a palmitoylamino group, a benzoylamino group and a toluoylamino group, etc.), etc.

Examples of the cycloalkyl groups represented by $R^1$, $R^2$, $R^3$ and $R^4$ which are bonded to a carbon atom on the ring of the compound of the present invention through one of the above-described divalent connecting groups include a cyclohexyloxy group, a cyclohexylcarbonyl group, a cyclohexyloxycarbonyl group, a cyclohexylamino group, a cyclohexenylcarbonyl group and a cyclohexenyloxy group, etc.

Examples of the aryl groups represented by $R^1$, $R^2$, $R^3$ and $R^4$ which are bonded to a carbon atom on the ring of the compound of the present invention through one of the above-described divalent connecting groups include aryloxy groups (for example, a phenoxy group and a naphthoxy group, etc.), aryloxycarbonyl groups (for example, a phenoxycarbonyl group and a naphthoxycarbonyl group, etc.), acyl groups (for example, a benzoyl group and a naphthoyl group, etc.), anilino groups (for example, a phenylamino group, an N-methylanilino group and an N-acetylanilino group, etc.), acyloxy groups (for example, a benzoyloxy group and a toluoyloxy group, etc.), arylcarbamoyl groups (for example, a phenylcarbamoyl group, etc.), arylsulfamoyl groups (for example, a phenylsulfamoyl group, etc.), arylsulfonylamino groups (for example, a phenylsulfonylamino group and a p-tolylsulfonylamino group, etc.), arylsulfonyl groups (for example, a benzenesulfonyl group and a tosyl group, etc.) and acylamino groups (for example, a benzoylamino group, etc.).

The alkyl groups, aryl groups, heterocyclic groups and cycloalkyl groups represented by $R^1$, $R^2$, $R^3$ and $R^4$ and the 6-member ring formed by combining $R^1$ and $R^2$, $R^2$ and $R^3$ or $R^3$ and $R^4$ described in the above may be substituted by halogen atoms (e.g., a chlorine atom, a bromine atom and a fluorine atom, etc.), a cyano group, straight chain or branched chian alkyl groups having 1 to 20 carbon atoms (e.g., a methyl group, an ethyl group, a propyl group, a butyl group, a hexyl group, an octyl group, a decyl group, a dodecyl group, a tetradecyl group, a hexadecyl group, a heptadecyl group, an octadecyl group and a methoxyethoxyethyl group, etc.), aryl groups having 6 to 14 carbon atoms (e.g., a phenyl group, a tolyl group, a naphthyl group, a chlorophenyl group, a methoxyphenyl group and an acetylphenyl group, etc.), alkoxy groups having 1 to 20 carbon atoms (e.g., a methoxy group, an ethoxy group, a butoxy group, a propoxy group and a methoxyethoxy group, etc.), aryloxy groups having 6 to 14 carbon atoms (e.g., a phenoxy group, a tolyloxy group, a naphthoxy group and a methoxyphenoxy group, etc.), alkoxycarbonyl groups having 2 to 20 carbon atoms (e.g., a methoxycarbonyl group, a butoxycarbonyl group and a phenoxymethoxycarbonyl group, etc.), aryloxycarbonyl groups having 7 to 15 carbon atoms (e.g., a phenoxycarbonyl group, a tolyloxycarbonyl group and a methoxyphenoxycarbonyl group, etc.), acyl groups having 2 to 20 carbon atoms (e.g., a formyl group, an acetyl group, a valeryl group, a stearoyl group, a benzoyl group, a toluoyl group, a naphthoyl group and a p-methoxybenzoyl group, etc.), acyloxy groups having 2 to 20 carbon atoms (e.g., an acetoxy group and an acyloxy group, etc.), acylamino groups having 2 to 20 carbon atoms (e.g., an acetamido group, a benzamido group and a methoxyacetamido group, etc.), anilino groups (e.g., a phenylamino group, an N-methylanilino group, an N-phenylanilino group and an N-acetylanilino group, etc.), alkylamino groups having 1 to 20 carbon atoms (e.g., an n-butylamino group, an N,N-diethylamino group and a 4-methoxy-n-butylamino group, etc.), carbamoyl groups (e.g., an n-butylcarbamoyl group, and an N,N-diethylcarbamoyl group, etc.), sulfamoyl groups (e.g., an n-butylsulfamoyl group, an N,N-diethylsulfamoyl group, an n-dodecylsulfamoyl group and an N-(4-methoxy-n-butyl)-sulfamoyl group, etc.), sulfonylamino groups (e.g., a methylsulfonylamino group, a phenylsulfonylamino group and a methoxymethylsulfonylamino group, etc.) or sulfonyl groups (e.g., a mesyl group, a tosyl group and a methoxymethanesulfonyl group, etc.), etc.

The alkyl groups represented by $R^5$, $R^6$, $R^7$, $R^8$ and $R^9$ include both substituted alkyl groups and unsubstituted alkyl groups, which may be any of straight chain alkyl groups and branched chain alkyl groups. These alkyl groups are preferably alkyl groups having 1 to 20 carbon atoms (excepting carbon atoms in the substituent), examples of which include a methyl group, an ethyl group, a propyl group, a butyl group, a hexyl group, an octyl group, a decyl group, a dodecyl group, a tetradecyl group, a hexadecyl group, a heptadecyl group and an octadecyl group, etc.

The aryl groups represented by $R^5$, $R^6$, $R^7$, $R^8$ and $R^9$ include both of substituted aryl groups and unsubstituted aryl groups. They are preferably aryl groups having 6 to 14 carbon atoms (excepting the carbon atoms in the substituents), examples of which include a phenyl group, a tolyl group and a naphthyl group.

Substituents in the alkyl groups or aryl groups represented by $R^5$, $R^6$, $R^7$, $R^8$ and $R^9$ include those described above for the alkyl groups or aryl groups represented by $R^1$ to $R^4$.

Further, the 5-member to 8-member aliphatic ring formed by combining $R^7$ and $R^8$ or $R^8$ and $R^9$ is preferably a cyclopentane ring, a cyclopentene ring, a cyclohexane ring and a cyclohexene ring, which may be substituted or not substituted. The substituents include those substituents described for the alkyl groups or aryl groups represented by $R^1$ to $R^4$.

The connecting groups represented by Z include the non-metallic atomic groups represented by the following formulae (a), (b), (c), (d) and (e).

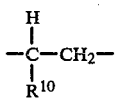
(a)

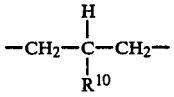
(b)

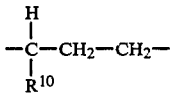
(c)

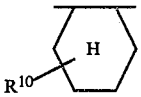
(d)

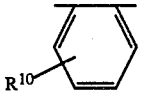
(e)

In the formulae, $R^{10}$ represents a hydrogen atom or an alkyl group. The alkyl group represented by $R^{10}$ includes both of substituted alkyl groups annd unsubstituted alkyl groups. The preferred alkyl groups have 1 to 20 carbon atoms (excepting carbon atoms in the substituents), which may be any of straight chain alkyl group and branched chain alkyl group. Examples of these alkyl groups include those shown for $R^1$, $R^2$, $R^3$ and $R^4$ above. The substituents for the alkyl group represented by $R^{10}$ include those substituents for the alkyl groups represented by $R^1$ to $R^4$ described above.

Among the above-described dye image stabilizer precursors of the present invention, compounds represented by the general formulae (I) and (II) and the aforementioned specific metal salts thereof and compounds represented by the following general formulae (IIIa), (IIIb) and (IVa) and the aforementioned specific metal salts thereof are preferred. Compounds of the formulae (IIIa), (IIIb) and (IVa) include the tautomers.

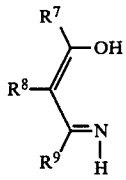
(IIIa)

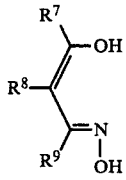
(IIIb)

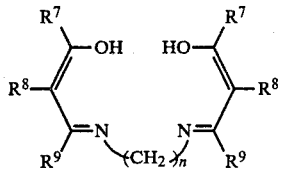
(IVa)

$R^7$, $R^8$ and $R^9$ each having the same meaning as above and n represents 2 or 3.

Among them, compounds which exhibit an especially excellent effect are those represented by the general formulae (I) and (II) and the aforementioned specific metal salts thereof. Further, among the compounds represented by the general formula (II) and aforementioned specific metal salts thereof, compounds represented by the following general formula (IIa) and the aforementioned specific metal salts thereof are preferred.

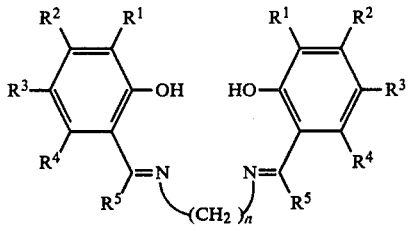
(IIa)

$R^1$ to $R^5$ each have the same meaning as described above, and n represents 2 or 3.

As described above, compounds represented by the general formulae (I) and (IIa) and aforementioned specific metal salts thereof are particularly suitable for use in the present invention. Among them, those wherein at least one of groups represented by $R^1$, $R^2$, $R^3$ and $R^4$ represents an alkyl group or an alkoxy group are preferred. Particularly, those wherein the total number of carbom atoms in the groups represented by $R^1$, $R^2$, $R^3$, $R^4$, $R^5$ and $R^6$ is 4 or more (about 32) produce excellent results.

On the other hand, as the aforementioned specific metal salts of the compounds represented by the general formulae (I), (II), (IIa), (III), (IIIa), (IIIb), (IV) and (IVa), zinc salts are the most preferred. However, compounds represented by the abovedescribed general formulae themselves (namely, free compounds which are not in salt form) are more suitable than the salts.

In the following, examples of dye image stabilizer precursors which are used in practicing the present invention are shown. The present invention is not limited to these compounds.
Dye Image Stabilizer Precursors
I-1
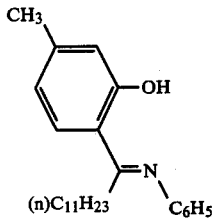
I-2
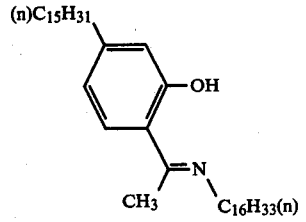
I-3
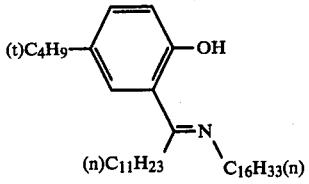
I-4
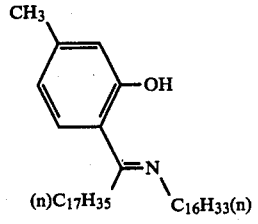
I-5
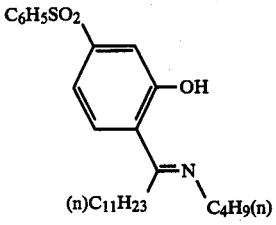
I-6
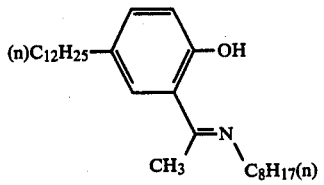
I-7
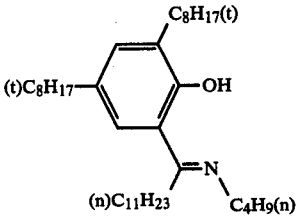
I-8
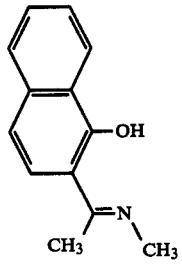
I-9
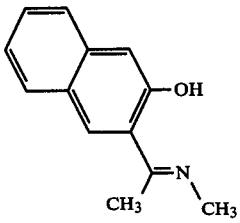
I-10
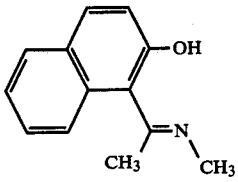
I-11
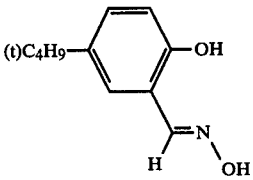
I-12
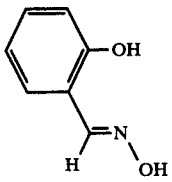

-continued
Dye Image Stabilizer Precursors
I-13
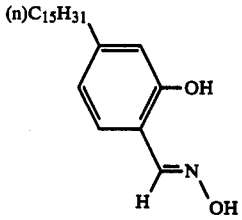
I-14
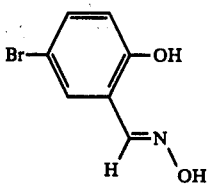
I-15
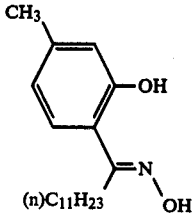
I-16
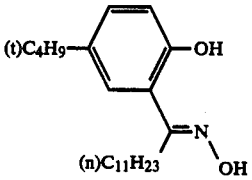
I-17
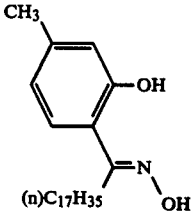
I-18
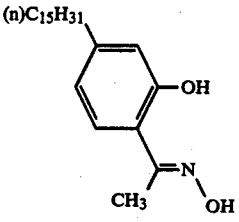
I-19
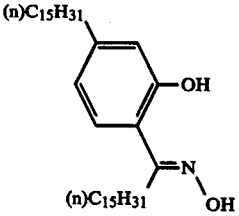
I-20
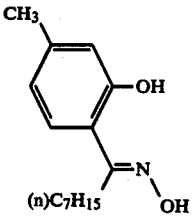
I-21
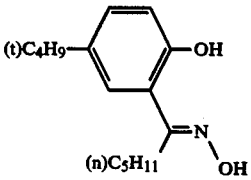
I-22
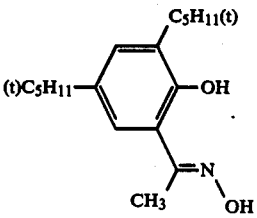
I-23
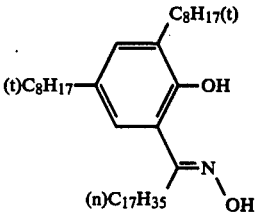
I-24
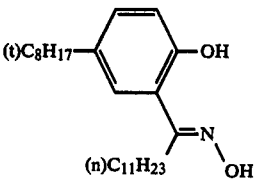

-continued
Dye Image Stabilizer Precursors
I-25
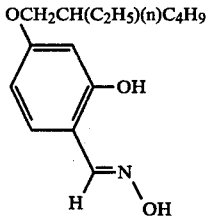
I-26
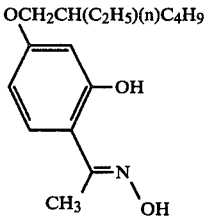
I-27
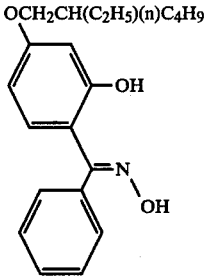
I-28
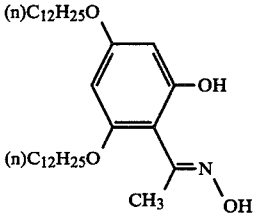
I-29
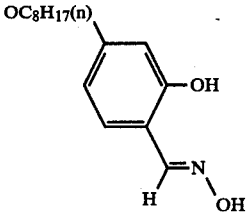
I-30
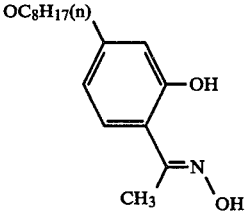
I-31
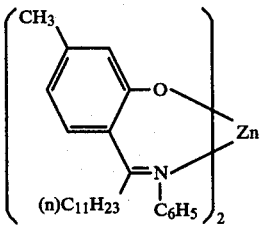
I-32
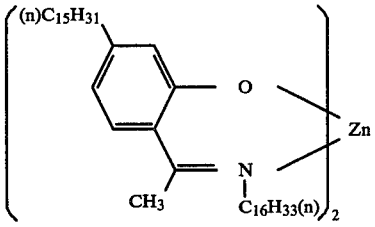
I-33
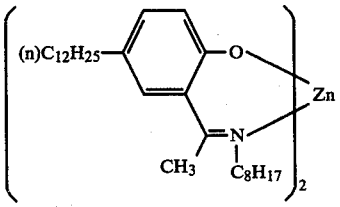
I-34
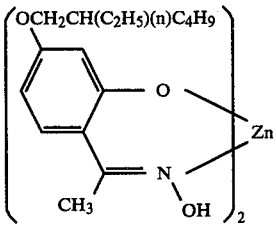
I-35
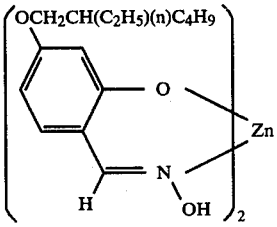
I-36
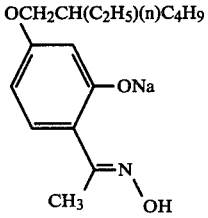

-continued
Dye Image Stabilizer Precursors
I-37
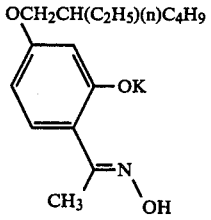
I-38
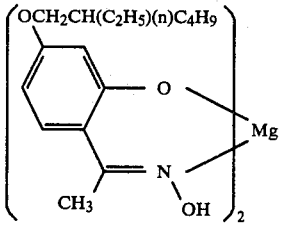
I-39
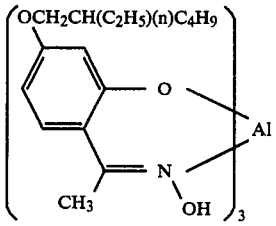
I-40
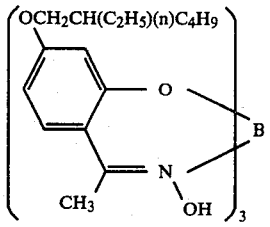
I-41
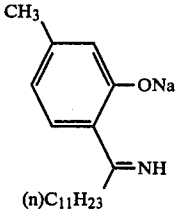
I-42
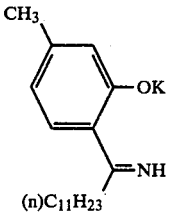
I-43
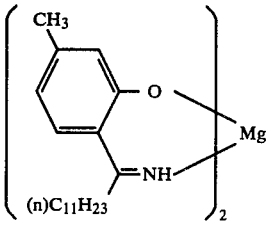
I-44
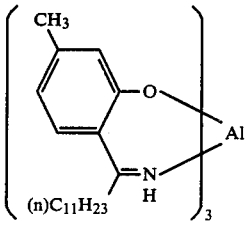
I-45
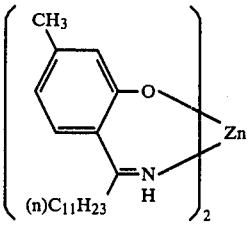
I-46
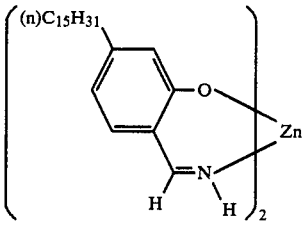
II-1
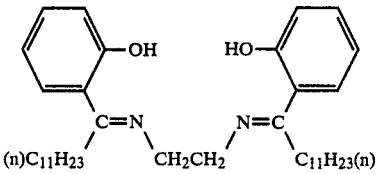
II-2
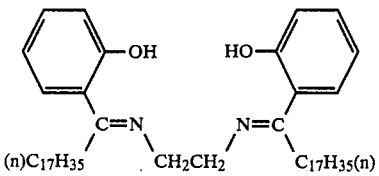

-continued
Dye Image Stabilizer Precursors
II-3
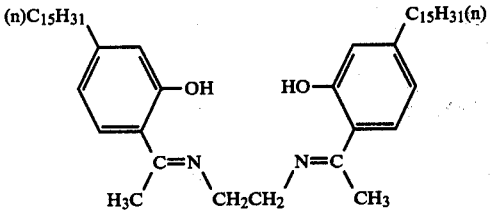
II-4
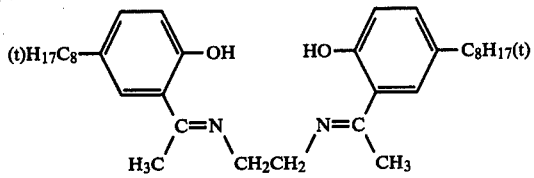
II-5
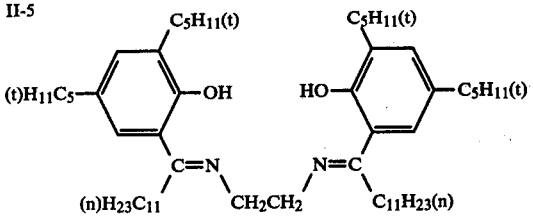
II-6
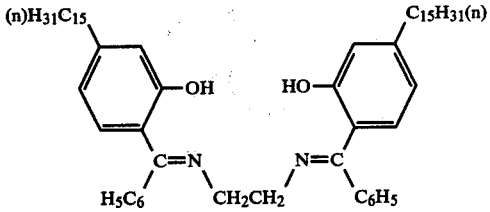
II-7
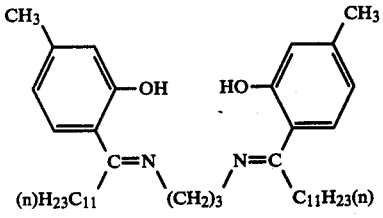
II-8
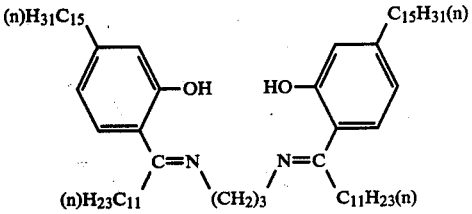
II-9
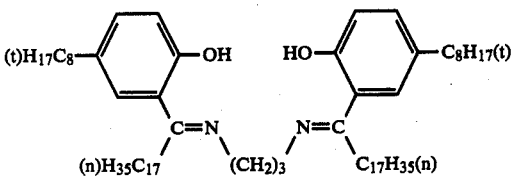
II-10
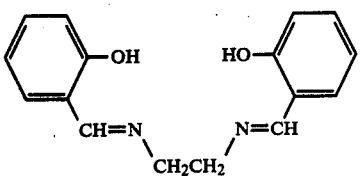
II-11
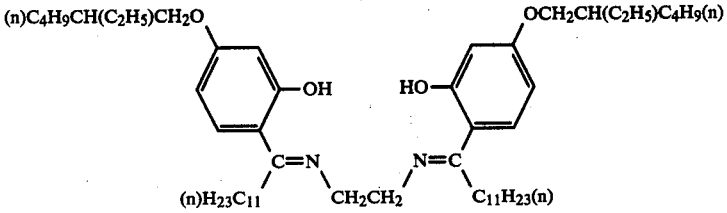
II-12
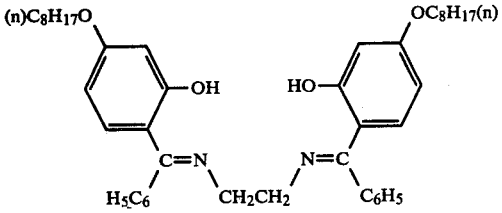
II-13
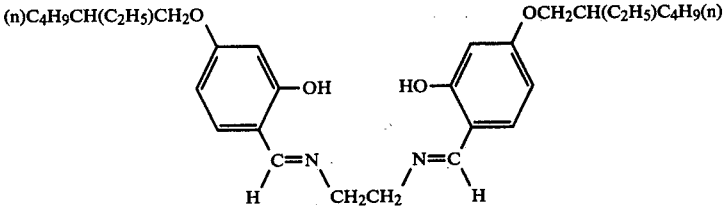

-continued
Dye Image Stabilizer Precursors
II-14
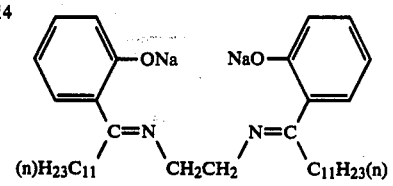
II-15
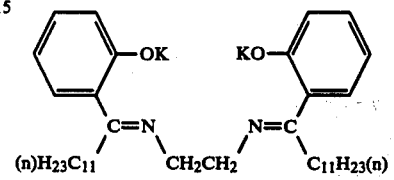
II-16
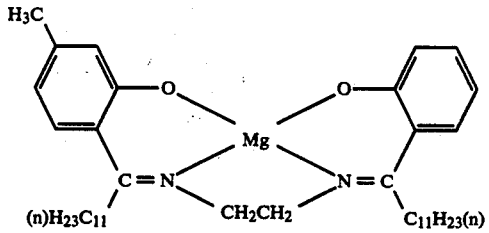
II-17
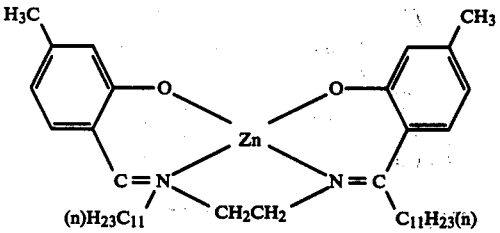
III-1
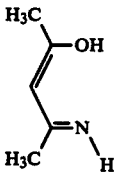
III-2
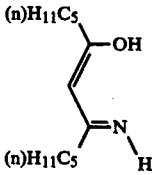
III-3
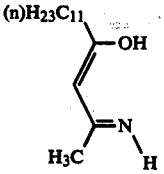
III-4
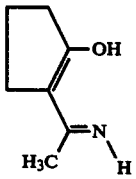
III-5
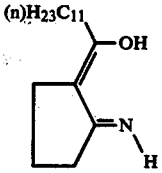
III-6
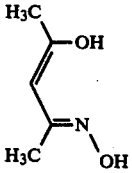
III-7
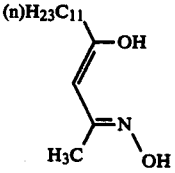
III-8
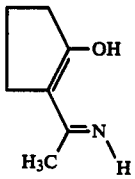
III-9
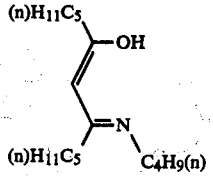

-continued
Dye Image Stabilizer Precursors
III-10
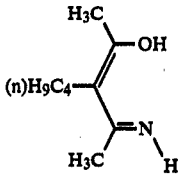
III-11
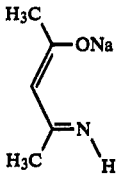
III-12
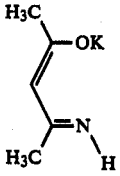
III-13
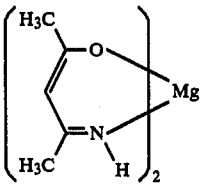
III-14
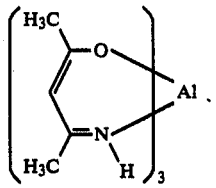
III-15
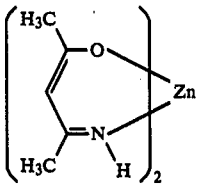
III-16
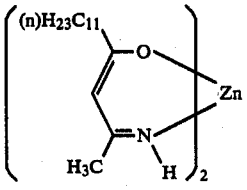
III-17
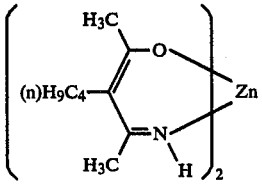
III-18
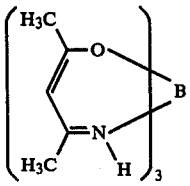
III-19
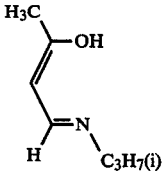
IV-1
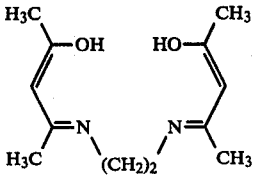
IV-2
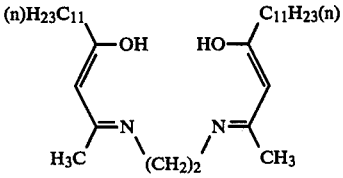
IV-3
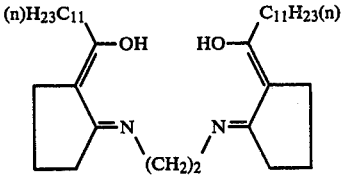
IV-4
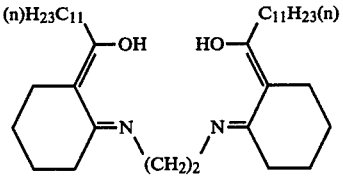

-continued

Dye Image Stabilizer Precursors

IV-5

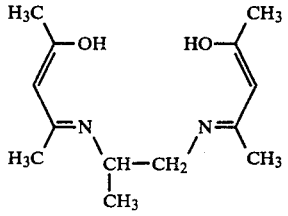

IV-6

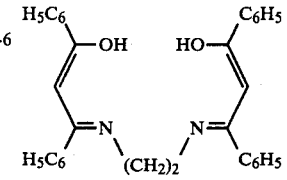

IV-7

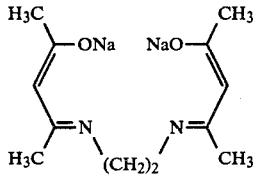

IV-8

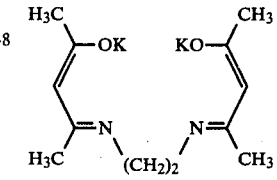

IV-9

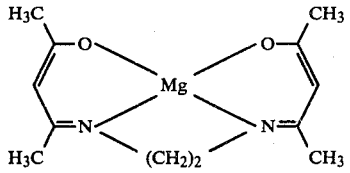

IV-10

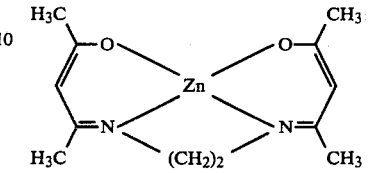

IV-11

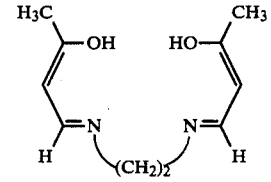

Common processes for synthesizing the above-described compounds used as precursors of fade preventing agent in the present invention have been described in P. Pfeiffer, et al., *J. Prakt. Chem.*, 129, 163 (1931) and R. H. Holm, et al., *Progr. Inorg. Chem.*, 7, 83 (1966). Generally, they are obtained by condensing the corresponding carbonyl compounds with primary amines. Typical examples of their syntheses follow.

SYNTHESIS EXAMPLE 1

Synthesis of Compound I-15

21 g of NaOH, 14 g of hydroxylamine sulfate and 48 g of 2-lauroyl-5-methylphenol were added to a mixture of 450 ml of water and 150 ml of ethanol, and the mixture was refluxed for 2 hours with stirring. The reaction solution was acidified to separate the organic phase and cooled. The precipitated crystals were separated by filtration and washed with water. Recrystallization was carried out using n-hexane. Thus 35 g of colorless crystals was obtained.

Elemental Analysis for $C_{19}H_{31}NO_2$: 305.46; Calcd.(%): C: 74.71 H: 10.23 N: 4.59. Found (%): C: 74.95 H: 9.98 N: 4.70.

SYNTHESIS EXAMPLE 2

Synthesis of Compound II-17

6.0 g of bis(2-lauroyl-5-methylphenol)ethylenediimine obtained by reacting 2-lauroyl-5-methylphenol with ethylenediamine in a conventional manner was dissolved in 50 ml of ethanol and the solution was refluxed. To this solution, a solution obtained by dissolving 3.1 g of zinc acetate dihydrate in 10 ml of ethanol was added dropwise. After conclusion of the addition, the solvent was condensed and the resulting white solid was recrystallized using benzene. Thus 4.6 g of fine crystals of Compound II-17 was obtained.

Elemental Analysis for $C_{40}H_{62}N_2O_2Zn$: 668.32; Calcd.(%): C: 71.89 H: 9.35 N: 4.19. Found (%): C: 71.60 H: 9.42 N: 4.39.

SYNTHESIS EXAMPLE 3

Synthesis of Compound III-1

200 ml of concentrated aqueous ammonia solution was added dropwise to 100 ml of acetylacetone. After conclusion of the addition, stirring was continued for 30 minutes. After extraction with ether, the organic phase was dried with Glauber salt. It was filtered. After removal of the solvent by distillation, it was cooled with ice, by which platy crystals were obtained.

Yield: 80 g.

Elemental Analysis for $C_5H_9NO$: 99.13; Calcd.(%): C: 60.58 H: 9.15 N: 14.13. Found (%): C: 60.79 H: 9.40 N: 13.92.

In the present invention, the term "color photographic sensitive material" includes all light-sensitive materials which form color images using a light-sensitive silver halide. For example, there are conventional color photographic sensitive materials wherein color images are formed by the reaction of couplers with the oxidation product of a color developing agent (including color coupler containing light-sensitive materials and light-sensitive materials processed in coupler-containing developers) and so-called diffusion transfer color photographic sensitive materials utilizing DRR compounds, DDR color couplers, amidrazone compounds or dye developing agents and color photographic sensitive materials utilizing a silver-dye bleaching process. Namely, the dye image stabilization process of the present invention is effective for stabilizing coloring matter or the dyes composing dye images (hereafter referred to as "dye image forming substance") in the above-described various color photographic sensitive materials to light.

The dye image forming substances suitable for use with the stabilization process of the present invention generally have a maximum wavelength absorption peak of less than about 800 nm. The maximum wavelength absorption peak of the dye image forming substances is preferably about 300 to 800 nm and particularly about 400 to 800 nm.

The dye image forming substances suitable for application of the stabilization process of the present invention include color couplers. Preferred couplers are non-diffusible couplers having a hydrophobic or so-called ballast group in the molecule thereof. The couplers may be 4-equivalent or 2-equivalent to silver ion. Further, the couplers include colored couplers which have a color correction effect and couplers which release a development inhibitor during development (a so-called DIR coupler).

As yellow forming couplers, known open chain ketomethylene couplers can be used. Among them, benzoylacetanilide compounds and pivaloylacetanilide compounds are advantageous. Examples of the yellow forming couplers are described in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Patent 1,425,020, Japanese Patent Publication No. 10783/76 and Japanese Patent Application (OPI) Nos. 26133/72, 73147/73, 102636/76, 6341/75, 123342/75, 130442/75, 21827/76, 87650/75, 82424/77 and 115219/77, etc.

As magenta forming couplers, pyrazolone compounds, imidazolone compounds and cyanoacetyl compounds can be used. Particularly, pyrazolone compounds are advantageously used. Examples of suitable magenta forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959 and 2,424,467, Japanese Patent Publication No. 6031/65 and Japanese Patent Application (OPI) Nos. 20826/76, 58922/77, 129538/74, 74027/74, 159336/75, 42121/77, 74028/74, 60233/75, 26541/76 and 55122/78, etc.

As cyan forming couplers, phenol compounds and naphthol compounds can be used. Examples are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329 and Japanese Patent Application (OPI) Nos. 59838/73, 26034/76, 5055/73, 146828/76, 69624/77 and 90932/77.

As colored couplers, those described in, for example, U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77 and German Patent Application (OLS) No. 2,418,959 can be used.

As DIR couplers, it is possible to use those described in U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 122335/74 and Japanese Patent Publication No. 16141/76.

Compounds which release a development inhibitor upon development other than DIR couplers may be present in the light-sensitive materials. For example, compounds described in U.S. Pat. Nos. 3,297,445 and 3,379,529, German Patent Application (OLS) No. 2,417,914 and Japanese Patent Application (OPI) Nos. 15271/77 and 9116/78 can be used.

Two or more of the above-described couplers may be added to the same layer. Two or more layers may contain the same compounds. The couplers are generally used in an amount of $2\times10^{-3}$ mol to $5\times10^{-1}$ mol, preferably $1\times10^{-2}$ mol to $5\times10^{-1}$ mol, per mol of silver in the emulsion layer.

Another type of dye image forming substance suitably used in the present invention is dyes formed by oxidation of DRR compounds such as described in U.S. Published Application B. 351,673, U.S. Pat. Nos. 3,932,381, 3,928,312, 3,931,144, 3,954,476, 3,929,760, 3,942,987, 3,932,380, 4,013,635 and 4,013,633, Japanese Patent Application (OPI) Nos. 113624/76, 109928/76, 104343/76 and 4819/77, Japanese Patent Application 64533/77, *Research Disclosure,* (November 1976), pages 68–74 and the same magazine No. 13024 (1975), etc.

Still another type of dye image forming substance used in the present invention is dyes which are released by reaction of DIR couplers with oxidation products of color developing agents and dyes which are formed by a reaction with oxidation products of color developing agents such as described in, for example, British Pat. Nos. 840,781, 904,364, 932,272, 1,014,725, 1,038,331, 1,066,352 and 1,097,064, Japanese Patent Application (OPI) No. 133021/76, U.S. Defensive Publication T. 900,020 and U.S. Pat. No. 3,227,550.

A further type of dye image forming substance suitably used in the present invention is dye developing agents such as described in Japanese Patent Publication Nos. 182/60, 18332/60, 32130/73, 43950/71 and 2618/74, etc.

Another type of dye image forming substance used in the present invention is various dyes used in silver-dye bleaching processes. As yellow dyes, there are azo dyes such as Direct Fast Yellow GC (C.I. 29000) and Chrysophenon (C.I. 24895), etc., benzoquinone dyes such as Indigo Golden Yellow IGK (C.I. 59101), Indigosol Yellow 2GB (C.I. 61726), Algosol Yellow GCA-CF (C.I. 67301), Indanthrene Yellow GF (C.I. 68420), Mikethren Yellow GC (C.I. 67300) and Indanthrene Yellow 4GK (C.I. 68405), etc., anthraquinone- and polynuclear-soluble vat dyes and other vat dyes, etc. As magenta dyes there are azo dyes such as Sumilight Supra Rubinol B (C.I. 29225) and Benzo Brilliant Geranine B (C.I. 15080), etc., indigoid dyes such as Indigosol Brilliant Pink IR (C.I. 73361), Indigosol Violet 15R (C.I. 59321), Indigosol Red Violet IRRL (C.I. 59316), Indanthrene Red Violet RRK (C.I. 67895) and Mikethren Brilliant Violet BBK (C.I. 6335), etc., soluble vat dyes comprising benzoquinone dyes, anthraquinone dyes or heterocyclic polynuclear compounds, and other vat dyes. As cyan dyes there are azo dyes such as Direct Sky Blue 6B (C.I. 24410), Direct Brilliant Blue 2B (C.I. 22610) and Sumilight Supra Blue G (C.I. 34200), etc., phthalocyanine dyes such as Sumilight Supra Turquoise Blue 5G (C.I. 74180) and Mikethren Brilliant Blue 4G (C.I. 74140), etc., Indanthrene Turquoise Blue 5G (C.I. 69845), Indanthrene Blue GCD (C.I. 73066), Indigosol 04G (C.I. 73046) and Anthrasol Green IB (C.I. 59826), etc.

The above-described dye-image stabilizer precursors of the present invention and the dye image forming substances can be added to any of or a plurality of hydrophilic colloid layers in the color photographic sensitive material. Although the dye image stabilizer precursors of the present invention and the dye image forming substances are preferably contained in the same emulsion layer, they may be added to different layers adjacent each other by which one of them diffuses into the other layer. Further, only the dye image stabilizer precursors may be added to an emulsion layer while the dye image forming substances are fed from a development processing solution to said emulsion layer.

Further, the process of the present invention can be applied to diffusion transfer film units, in which case the dye image stabilizer precursors are preferably contained in the layer in which dye images are finally formed. Therefore, the dye image stabilizer precursors are sometimes added to nonsensitive layers other than the emulsion layers, such as a color image receiving layer. In the case the dye images and the dye image stabilizer precursors are present in the nonsensitive layer such as a dye image receiving layer, it is preferred that the dye images are mordanted to keep them in the presence of the precursors and the dye image stabilizer precursors are in a molecular configuration so as to be held in the mordanting layer of the dye image receiving layer.

In case of using the process of the present invention to improve the light resistance of diffusion transfer dye images, there are several types believed to be effective. One of them is inhibition transfer film units as described in U.S. Pat. No. 2,882,156. Another one is color image transfer film units as described in U.S. Pat. Nos. 2,087,817, 3,185,567, 2,983,606, 3,253,915, 3,227,550, 3,227,551, 3,227,552, 3,415,644, 3,415,645, 3,415,646, 3,594,164 and 3,594,165 and Belgian Pat. Nos. 757,959 and 757,960.

The dye image stabilizer precursors and the dye image forming substances used in the present invention can be used together with materials described in *Product Licensing Index*, Vol. 92 (December, 1971), No. 9232, pages 107–110 according to a method described therein.

Since any amount of the dye image stabilizer precursors should bring about some improvement in the present invention, the maximum amount to be used is not theoretically limited. It is preferred that the dye image stabilizer precursors are present in an amount of at least 1 micromol per square meter of the light-sensitive material. It is more preferred that the dye image stabilizer precursors are present in an amount of about 10 to $1\times10^4$ micromols per square meter.

Generally, the color image forming substances are used in conventional amounts. These concentrations are well known to persons skilled in the color photographic arts. It is preferred that the dye image forming substances are present in an amount of about 10 to $10^4$ micromols per square meter of the light-sensitive material. It is more preferred that they are present in an amount of about 100 to about $3\times10^3$ micromols per square meter of the light-sensitive material.

The dye image stabilizer precursors of the present invention are advantageously used in the production of color photographic sensitive materials because their solubility in the solvents conventionally used in adding additives to the emulsions is by far better than that of known fade preventing agents comprising metal complexes.

The dye image stabilizer precursors of the present invention can be added to hydrophilic colloids composing the photographic layers as a solution in, for example, organic solvents having a low boiling point or water miscible organic solvents, for example, a solvent which does not adversely affect photographic properties selected from alcohols (methanol, ethanol, isopropanol and butanol, etc.), ethers (dimethyl ether, ethyl methyl ether, diethyl ether and 1-ethoxypropane, etc.), glycols (1,2-ethanediol, 1,2-propanediol and 1,3-propanediol, etc.), ketones (acetone, ethyl methyl ketone and 3-pentanone, etc.), esters (ethyl formate, methyl acetate and ethyl acetate, etc.), and amides (formamide, acetamide and succinic acid amide, etc.). They are preferably added prior to application, such as in producing the silver halide photographic emulsion, when dispersing the coupler by emulsification or preparing a photographic coating solution, etc.

Further, in order to introduce the dye image stabilizer precursors into hydrophilic colloids composing the photographic layer, it is possible to use the same processes as those used for dispersing couplers. Namely, U.S. Pat. Nos. 2,304,939 and 2,322,027 disclose the use of organic solvents having a high boiling point. Other processes that can be used have been described in U.S. Pat. Nos. 2,801,170, 2,801,171 and 2,949,360, wherein organic solvents having a low boiling point or water-soluble organic solvents are used together with solvents having a high boiling point.

The solvents having a high boiling point effective for dispersing the dye image stabilizer precursors of the present invention and the dye image forming substances include di-n-butyl phthalate, benzyl phthalate, triphenyl phosphate, tri-o-cresyl phosphate, diphenyl mono-p-tert-butylphenyl phosphate, monophenyl di-p-tert-butylphenyl phosphate, diphenyl mono-o-chlorophenyl phosphate, monophenyl di-o-chlorophenyl phosphate, 2,4-di-n-amylphenol, 2,4-di-t-amylphenol, N,N-diethyl laurylamide and trioctyl phosphate and trihexyl phosphate described in U.S. Pat. No. 3,676,137.

The solvents having a low boiling point and the water-soluble organic solvents suitable for use together with the solvents having a high boiling point have been disclosed in, for example, U.S. Pat. Nos. 2,801,171, 2,801,170 and 2,949,360.

These organic solvents include:

(1) Substantially water-insoluble organic solvents having a low boiling point, for example, methyl acetate, ethyl acetate, propyl acetate and butyl acetate, isopropyl acetate, ethyl propionate, sec-butyl alcohol, ethyl formate, butyl formate, nitromethane, nitroethane, carbon tetrachloride and chloroform, etc., and (2) Water-soluble organic solvents, for example, methyl isobutyl ketone, β-ethoxyethyl acetate, β-butoxytetrahydrofurfuryl adipate, diethylene glycol monoacetate, methoxytriglycol acetate, acetonylacetone, diacetone alcohol, ethylene glycol, diethylene glycol, dipropylene glycol, acetone, methanol, ethanol, acetonitrile, dimethylformamide and dioxane, etc.

For the color photographic sensitive materials used in the process of the present invention, any base used for conventional color photographic sensitive materials can be used. For example, there are cellulose nitrate films, cellulose acetate films, cellulose acetate butyrate films, cellulose acetate propionate films, polystyrene films, polyethylene terephthalate films, polycarbonate films and laminates of these films, and paper, etc. Further, it is preferred to use bases such as paper coated or laminated with baryta or α-olefin polymer, particularly polymers of α-olefin having 2 to 10 carbon atoms such as polyethylene or polypropylene, etc., and plastic films the surface of which was roughened so as to have an improved adhesive property to other high molecular materials, as described in Japanese Patent Publication No. 19068/72.

In the color photographic sensitive materials used in the process of the present invention, various hydrophilic colloids are used. Examples of hydrophilic colloids used as binders for photographic emulsions and/or other photographic layers include gelatin, colloidal albumin, casein, cellulose derivatives such as carboxy methyl cellulose or hydroxyethyl cellulose, sugar derivatives such as agar, sodium alginate or starch derivatives, etc., and synthetic hydrophilic colloids such as polyvinyl alcohol, poly-N-vinylpyrrolidone, acrylic acid copolymers, maleic acid anhydride copolymers, polyacrylamide or derivatives of them and partially hydrolyzed products thereof, etc. If desired, two or more of these colloids are used as a compatible mixture.

Among them, though gelatin is the most generally used, a part or the whole of the gelatin can be substituted by a synthetic high molecular materials. Further, gelatin may be substituted by the so-called gelatin derivatives, namely substances obtained by processing gelatin with a chemical having a group capable of reacting with amino, imino, hydroxyl and carboxyl groups as functional groups contained in the molecule or graft polymers obtained by bonding molecule chains of another high molecular material.

The photographic emulsion layers and other layers used in the present invention may contain synthetic polymer compounds, for example, water-dispersible latex polymers of vinyl compounds and particularly compounds which improve dimensional stability of the photographic materials, alone or as a mixture of them or together with a hydrophilic water-permeable colloid.

The silver halide photographic emulsions used in the process of the present invention are produced by mixing a solution of water-soluble silver salts (for example, silver nitrate) with a solution of water-soluble halogen salts (for example, potassium bromide) in the presence of a solution of water-soluble high molecular material such as gelatin. As the silver halide, not only silver chloride and silver bromide but also mixed silver halides such as silver chlorobromide, silver iodobromide or silver chlorobromoiodide, etc., can be used. Particles of these silver halides are produced according to known conventional processes. Of course, they are advantageously produced by a so-called single or double jet process or control double jet process, etc. Further, two or more silver halide photographic emulsions prepared respectively may be mixed.

In order to prevent deterioration of sensitivity and occurrence of fogging when producing the light-sensitive materials or during storage or processing them, various compounds can be added to the above-described photographic emulsions. As such compounds, quite many compounds have been known hitherto, which include many heterocyclic compounds including 4-hydroxy-6-methyl-1,3,3a,7-tetrazaindene, 3-methylbenzothiazole and 1-phenyl-5-mercaptotetrazole, mercury containing compounds, mercapto compounds and metal salts, etc.

The silver halide emulsions used in the process of the present invention may be chemically sensitized by conventional processes. As chemical sensitizers, there are gold compounds such as chloroaurate or gold trichloride, etc., salts of noble metals such as platinum, palladium, iridium or rhodium, sulfur compounds which form silver sulfide by reacting with silver salts, such as sodium thiosulfate, and stannous salts, amines and other reducing substances, etc.

The silver halide emulsions used in the process of the present invention, if necessary, may be subjected to spectral sensitization of supersensitization with using one or more cyanine dyes such as cyanine, merocyanine or carbocyanine dyes, etc., or using a combination of these cyanine dyes with styryl dyes, etc. Selection of the dyes can be suitably carried out according to the purpose or use of the light-sensitive materials, such as a wavelength range to be sensitized or sensitivity, etc.

The hydrophilic colloid layers of the light-sensitive materials used in the process of the present invention may be hardened, if necessary, with various hardening agents. For example, the hardening agent can be used by selecting from aldehyde compounds, active halogen compounds, vinylsulfone compounds, carbodiimide compounds, N-methylol compounds and epoxy compounds, etc.

The dye image stabilization process of the present invention is carried out by processing the color photographic sensitive materials containing the dye image stabilizer precursor as described above with a solution containing divalent ions of metal selected from copper, cobalt, nickel, palladium and platinum (referred to as stabilizing solution, hereafter) when carried out conventional processings of the color photographic sensitive materials after imagewise exposing to light. The nature of the salt, i.e., the selection of the anion, is not critical as long as the anion does not interfere with the photographic properties.

The processing with a stabilizing solution described above is a treatment in which the divalent ions of metal in the stabilizing solution permeate the layer containing the dye images and the dye image stabilizer precursors in the color photographic sensitive material. When the precursor meets the divalent metal ion by, e.g., permeating the layer containing the precursor with the stabilization solution containing the divalent metal ion, a metal chelate would be formed. The step where the metal chelate is formed depends upon a step at which the precursor meets the metal ion. Various methods can be used such as dipping the color photographic sensitive material in the stabilizing solution, spraying the stabilizing solution on the color photographic sensitive material or spreading the stabilizing solution between layers of the color photographic sensitive material.

The stabilizing solution is obtained by dissolving a salt of metal selected from the group consisting of copper, cobalt, nickel, palladium and platinum in a solvent. As the solvent, water is the most preferred. However, organic solvents soluble in water in a suitable ratio, for example, alcohols (methanol, ethanol or methyl cellosolve, etc.), ketones (acetone or dioxane, etc.) and amides (dimethylformamide, etc.) can be used together with water or instead of water. Accordingly, as salts of the above-described metal, water-soluble salts and, preferably, salts dissolving in water in a concentration of 0.01 g or more per 100 ml and preferably at least 0.05 g per 100 ml of water at a room temperature are used. Examples of such metal salts include halogen salts (cuprous chloride and cuprous bromide, etc.), salts of oxyacids (cobalt nitrate, cobalt carbonate, nickel sulfate, palladium phosphate and platinum phosphite, etc.) and salts of organic acids (copper formate, nickel acetate, cobalt citrate and palladium oxalate, etc.).

Although the concentration of metal salts in the stabilizing solution is not particularly critical, it is generally about 0.01 g/100 ml to 50 g/100 ml, preferably 0.05 g/100 ml to 20 g/100 ml because of effectively carrying out the stabilization processing.

The stabilizing solution may contain known supplemental additives of processing solutions for color photographic sensitive materials, such as acids or alkalis for controlling pH, salts for controlling ion strength, preservatives such as antioxidants for stabilizing the solution and/or surface active agents, etc. They can be referred to the description of *Product Licensing Index,* No. 9232 (1971).

Further, it is preferred that the processing with this stabilizing solution is carried out at, generally, a temperature range of 5° C. to 50° C., particularly about 15° C. to 40° C. for, generally, 5 seconds to 60 minutes, particularly, 1 minute to 10 minutes.

The stabilizing solution in the present invention may be added to a conventional processing bath or processing composition for processing color photographic sensitive materials. Further, the stabilization processing in the present invention may be carried out after the above-described conventional processing. It is preferred that the stabilization processing of the present invention is carried out after formation of dye images. Stabilization of the present invention can be effected at any stage during before color development and after blix (or bleach and fix), as long as the precursor is brought in a state where it meets the metal ion to form a metal chelate or complex. Most preferred stage for the stabilization is after blix (or bleach followed by fix).

The present invention is most effective in stabilizing dye images of color photographic sensitive materials which are formed by coupling reactions of couplers with oxidation products of a color developing agent. Particularly, a remarkably excellent result is obtained in improving the light resistance of a magenta image.

In order to obtain dye images using the abovedescribed color photographic sensitive materials, it is necessary to carry out color photographic development processing after exposure to light. Color photographic development processing comprises basically a color development step, a bleaching step and a fixing step. Two steps may be carried out by one processing. Further, a combination of color development, the first fixing and bleach-fixing can be utilized. The development processing step is combined, if necessary, with various steps such as prehardening, neutralizing, a first development (black-white development), image stabilizing and water washing, etc. The processing temperature is often 18° C. or more. Typically the temperature is in the range of about 20° C. to 60° C. and, in some cases, 30° C. to 60° C. The stabilizing solution of the present invention can be added to one or more of the above-described processing baths. In this case, it is preferably added to a bleaching bath, a fixing bath or a bleach-fixing bath. It is particularly preferred that the stabilization processing be carried out providing a stabilization bath containing the stabilizing solution of the present invention after fixing.

The color developing solution is an aqueous alkaline solution having a pH of 8 or more, preferably, 9 to 12 containing an aromatic primary amine color developing agent. Examples of the preferred color developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxyethyl-N-β-methoxyethylaniline, 4-amino-3-β-methanesulfonamidoethyl-N,N-diethylaniline and salts of them (for example, sulfates, chlorides, sulfites and p-toluenesulfonates, etc.). In addition, other examples have been described in U.S. Pat. Nos. 2,193,015 and 2,592,364, Japanese Patent Application (OPI) No. 64933/73 and *Photographic Processing Chemistry,* written by L. F. A. Mason, pages 226–229 (Focal Press, London, 1966).

The color developing solution may contain pH buffering agents such as sulfites, carbonates, borates and phosphates of alkali metals or development restrainers or anti-fogging agents such as bromides, iodides and organic anti-fogging agents.

Examples of the anti-fogging agents include potassium bromide, potassium iodide, nitrobenzimidazoles described in U.S. Pat. Nos. 2,496,940 and 2,656,271, mercaptobenzimidazole, 5-methylbenzotriazole, 1-phenyl-5-mercaptotetrazole, compounds described in U.S. Pat. Nos. 3,113,864, 3,342,596, 3,295,976, 3,615,522 and 3,597,199, thiosulfonyl compounds described in British Patent 972,211, phenazine-N-oxides described in Japanese Patent Publication No. 4167/71 and anti-fogging agents described in Kagaku Shashin Binran, Vol. 2, pages 29–47.

Further, the color developing solution may contain, if necessary, water softeners, preservatives such as hydroxylamine, organic solvents such as benzyl alcohol or diethylene glycol, development accelerators such as polyethylene glycol, quaternary ammonium salts or amines, fogging agents such as dye forming couplers, competitive couplers or sodium borohydride, supplemental developing agents such as 1-phenyl-3-pyrazolidone, and thickening agents, etc.

The color photographic sensitive materials of the present invention are subjected to conventional color development processing but they may be subjected to the following color intensification development processing. For example, processes using peroxides described in U.S. Pat. Nos. 3,674,490 and 3,761,265, German patent Application (OLS) No. 2,056,360, Japanese Patent Application (OPI) Nos. 6338/72 and 10538/72, and Japanese Patent Application Nos. 89898/75, 89897/75 and 89899/75, etc., processes using cobalt complex salts described in German Patent Application (OLS) No. 2,266,770, Japanese Patent Application (OPI) Nos. 9728/73 and 9729/73 and Japanese Patent Application Nos. 76101/74, 20196/75, 57041/75, 83863/75 and 87484/75, etc., and processes using chlorous acid described in Japanese Patent Application Nos. 128327/74, 139917/74 and 27784/75, etc., can be used.

The photographic emulsion layers after color development are usually subjected to bleaching processing. The bleaching processing may be carried out simultaneously with fixing processing or may be carried out respectively. As the bleaching agent, compounds of polyvalent metal such as iron (III), cobalt (III), chromium (VI) or copper (II), etc., peracids, quinones and nitroso compounds are used. For example, it is possible to use ferricyanides, bichromates, organic complex salts of iron (III) or cobalt (III), complex salts of aminopolycarboxylic acids such as ethylenediaminetetraacetic acid, nitrilotriacetic acid or 1,3-diamino-2-propanol tetraacetic acid, etc., or complex salts of organic acids such as citric acid, tartaric acid or malic acid, etc., persulfates, permanganates, and nitrosophenols, etc. Among them, potassium ferricyanide, sodium ethylenediaminetetraacetato iron (III) complex and ammonium ethylenediaminetetraacetato iron (III) complex are particularly useful. Ethylenediaminetetraacetato iron (III) complexes are useful for both of the bleaching solution and the onebath bleach-fixing solution.

The bleaching or bleach-fixing solution may contain various additives including a bleach accelerator described in U.S. Pat. Nos. 3,042,520 and 3,241,966 and Japanese Patent Publication Nos. 8506/70 and 8836/70, etc.

Another embodiment of the stabilization process of the present invention is the case of stabilizing dye images of diffusion transfer color photographic sensitive materials. The dye images of the color photographic sensitive materials in this case are formed by spreading a processing composition on the surface of said material. In this case, according to the process of the present invention, the stabilizing solution of the present invention is added to the above-described processing composition or the above-described sensitive materials are processed with the stabilizing solution of the present invention after carrying out the above-described processing.

This processing composition is a liquid composition containing components necessary to develop the silver halide emulsions and to form diffusion transfer dye images, wherein the solvent is composed mainly of water and may contain hydrophilic solvents such as methanol or methyl cellosolve. The processing composition contains alkalis in an amount sufficient to maintain a pH necessary for development of the emulsion layers and to neutralize acids formed during development and dye image formation steps (for example, hydrohalogenic acids such as hydrobromic acid, etc., and carboxylic acids such as acetic acid, etc.). As the alkalis used, there are lithium hydroxide, sodium hydroxide, potassium hydroxide, calcium hydroxide dispersion and alkali metal salts, alkaline earth metal salts and amines such as tetramethylammonium hydroxide, sodium carbonate, sodium tertiary phosphate or diethylamine, etc. Preferably the alkali hydroxide is present in such an amount that the pH at a room temperature is about 12 or more, particularly, 14 or more. It is more preferred that the processing composition contain hydrophilic polymers such as a high molecular weight polyvinyl alcohol, hydroxyethyl cellulose or sodium carboxymethyl cellulose. These polymers not only impart a viscosity of 1 poise or more, preferably several hundreds (500–600) to 1,000 poise at room temperature to the processing composition so that uniform spread of the processing composition is easily carried out during the processing, but also they form a non-fluid membrane when the processing composition is condensed by movement of the aqueous solvent to the light-sensitive element and the image receiving element, to assist unification of the film unit after the processing. This polymer membrane controls the movement of coloring components into the image receiving layer to prevent discoloration of the images after substantial conclusion of the formation of diffusion transfer dye images.

In addition, it is sometimes advantageous that the processing composition contains light absorbing substances such as $TiO_2$, carbon black or a pH indicating dye or desensitizers described in U.S. Pat. No. 3,579,333 in order to prevent fogging of the silver halide emulsions due to outer light during processing. Further, development restrainers such as benzotriazole may be added to the processing composition.

The above-described processing composition is preferably used in a breakable container as described in U.S. Pat. Nos. 2,543,181, 2,643,886, 2,653,732, 2,723,051, 3,056,491, 3,056,492 and 3,152,515.

In another embodiment of the stabilization process of the present invention dye images produced by the silver-dye bleaching process are stabilized.

In order to obtain dye images in this case, steps of black-white development, dye bleaching and desilvering are basically required. In this case, the stabilization process of the present invention is carried out by adding the stabilizing solution of the present invention to the processing solution at any step or to an auxiliary processing solution or is attained by providing a stabilizing bath containing the stabilizing solution of the present invention between the abovedescribed steps or after the desilvering step.

Details of the above-described black-white development, dye bleaching, desilvering and other steps and chemicals to be used have been described in, for example, U.S. Pat. Nos. 2,020,775, 2,221,754, 2,255,463, 2,699,394, 2,341,034, 1,517,049, 2,184,022, 2,311,015, 2,304,987, 2,322,087, 2,326,055, 2,322,001 and 2,353,661, and the steps can be easily practiced with reference to the descriptions in these references.

The dye image stabilization process of the present invention has the advantages that the light resistance of the dye images can be improved without adversely influencing the color of the dye images, because substances for stabilizing the dye images have less color, and dye images including magenta dye images can be stabilized as compared with the above-described process described in U.S. Pat. No. 3,762,922. Further, according to the present invention which is different from processes wherein metal complexes are added upon production of light-sensitive materials, the dye image stabilization effect is excellent, because dye image stabilizer precursors having a high solubility in the solvents commonly used for photographic additives (particularly, organic solvents) are used by which a suitable amount thereof can be added to the light-sensitive materials. Further, the present invention is advantageous in designing sensitive materials, because it is not necessary to consider the influence of central metal on photographic properties because it is not added until after exposure.

In the following, the present invention will be illustrated in greater detail with reference to examples.

EXAMPLE 1

The following experiment was carried out in order to illustrate the effects of the stabilization process of the present invention.

0.1 g of 1-(2,4,6-trichlorophenyl)-3-(2-chloro-5-tetradecanamido)anilino-4-[4-(N-ethyl-N-β-methanesulfonamidoethyl)aminophenylimino]-5-oxo-2-pyrazoline, a dye used for forming a magenta dye image in conventional color photographic materials, was dissolved in a mixture of 3 ml of tricresyl phosphate and 5 ml of ethyl acetate, and the resulting solution was dispersed in 10 g of a 10% gelatin solution containing 1 ml of a 1% aqueous solution of sodium dodecylbenzenesulfonate by emulsification. The resulting emulsified dispersion was mixed with 10 g of 10% gelatin and the mixture was applied to a paper base both surfaces of which were laminated with polyethylene, and dried. In polyethylene on the side to which the coating solution was applied, $TiO_2$ was dispersed in order to increase whiteness. To the resulting layer, a gelatin protective layer (gelatin: 1 g/m$^2$) was applied to produce Sample A.

Sample B was produced by adding 30 mg of Compound I-15 of the present invention in producing an emulsified dispersion in the same manner as in Sample A. Sample C and Sample D were produced by adding 15 mg and 150 mg of 2,5-di-tert-octylhydroquinone, a known fade preventing agent, respectively, and applying the dispersion in the same manner as Sample A. The application was carried out so that the amount of the dye applied was 60 mg, respectively. Samples A' to D', which were obtained by processing the Samples A to D with the following stabilizing solution of the present invention in the following manner and washing with water, and Samples A to D (which were not treated with the stabilizing solution) were subjected to a fading test for 48 hours using a xenon tester (luminance: 200,000 lux) equipped with an ultraviolet ray filter C-40 produced by Fuji Photo Film Co. The results are shown in Table I.

| Composition of Stabilizing Solution | | |
|---|---|---|
| $Ni(CH_3COO)_2.4H_2O$ | 2.5 g | |
| Water to make | 1,000 ml | |
| Stabilization Processing Step | Temperature (°C.) | Time (minutes) |
| Stabilizing Solution | 33 | 3 |
| Water Wash | 28–35 | 3 |

TABLE I

| Sample | Initial Density | Density after Fading Test | Note |
|---|---|---|---|
| A | 0.82 | 0.12 | Comparison |
| A' | 0.81 | 0.11 | " |
| B | 0.81 | 0.13 | " |
| B' | 0.82 | 0.70 | Invention |
| C | 0.81 | 0.23 | Comparison |
| C' | 0.80 | 0.24 | " |
| D | 0.79 | 0.41 | " |
| D' | 0.79 | 0.40 | " |

Note:
Samples A–D: not treated with the stabilizing solution
Samples A'–D': treated with the stabilizing solution.

Measurement was carried out by means of a Macbeth densitometer type RD 514 with using a green filter of Status AA filters. In Sample B' containing Compound I-15 of the present invention which was processed with the stabilizing solution of the present invention, light fading was very small as compared with other Samples A to D, A', C' and D'. In Sample C and Sample D, it was ascertained that prevention of light fading was slight although di-tert-octylhydroquinone was added in the same mol or 10 times larger than that of Compound I-15 of the present invention. This shows that the stabilization process of the present invention has a surprising effect for preventing light fading of dyes used for formation of dye images for color photography.

EXAMPLE 2

0.1 g of a dye represented by the following formula used as a colored coupler for conventional color negative sensitive materials was dissolved using 0.2 ml of 1 N NaOH and 2 ml of methanol, and the resulting solution was added to 10 g of 10% gelatin. This solution was applied to a paper base both surfaces of which were laminated with polyethylene, so as to contain 80 mg/m$^2$ of the dye represented by the following formula. To the resulting layer, a protective layer having the same thickness as in Example 1 was applied (Sample E).

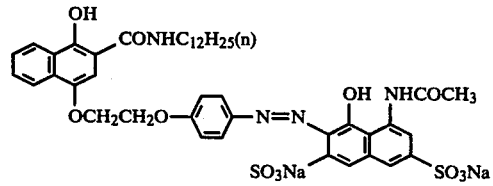

Sample F was produced by adding a solution prepared by dissolving 40 mg of Compound I-15 of the present invention in 2 ml of methanol, just before application and applied in the same manner as in Sample E. Sample G as a comparative sample was produced by adding 20 mg of 2,5-di-tert-octylhydroquinone known as an agent for preventing light fading of dyes and applied in the same manner. Further, the stabilization processing of these samples was carried out in the same manner as in Example 1 to produce Samples E', F' and G'. These Samples E to G and E' to G' were subjected to a fading test for 12 hours using an ultraviolet ray absorbing filter in the same manner as in Example 1. The results are shown in Table II.

TABLE II

| Sample | Initial Density | Density after Fading Test | Note |
|---|---|---|---|
| E | 0.90 | 0.11 | Comparison |
| E' | 0.89 | 0.10 | " |
| F | 0.90 | 0.13 | " |
| F' | 0.91 | 0.64 | Invention |
| G | 0.91 | 0.29 | Comparison |
| G' | 0.91 | 0.28 | " |

Note:
Samples E–G: not treated with the stabilizing solution
Samples E'–G': treated with the stabilizing solution The measurement was carried out by means of a Macbeth densitometer in the same manner as in Example 1. It is understood from the results of experiment that the stabilization process of the present invention has a very excellent ability to prevent light fading of the dye used as a coupler in the color negative sensitive material.

EXAMPLE 3

10 g of magenta coupler: 1-(2,4,6-trichlorophenyl)-3-[(2-chloro-5-tetradecanamide)anilino]-2-pyrazoline-5-one was dissolved in a mixture of 30 ml of tricresyl phosphate, 5 ml of dimethylformamide and 15 ml of ethyl acetate, and the resulting solution was dispersed in 80 g of a 10% gelatin solution containing 8 ml of a 1% aqueous solution of sodium dodecylbenzenesulfonate by emulsification.

The resulting emulsified dispersion was then mixed with 145 g (Ag content: 7 g) of a green-sensitive silver chlorobromide emulsion (Br: 50% by mol), and sodium dodecylbenzenesulfonate was added thereto as a coating assistant. The mixture was applied to a paper base both surfaces of which were laminated with polyethylene. To the resulting layer, a gelatin protective layer (gelatin: 1 g/m$^2$) was applied to produce Sample H. The amount of the coupler applied was 400 mg/m$^2$.

Sample I was produced by adding 2.3 g of Compound II-3 of the present invention in the case of producing the above-described emulsified dispersion and applying the dispersion in the same manner as in Sample H. Sample J was produced by adding 1.0 g of 2,5-di-tertoctylhydroquinone known as an agent for preventing light fading of dyes and applying the dispersion in the same manner as in Sample H. Sample K was produced by adding 3.0 g of a known agent for preventing light fading represented by the following formula (a) and applying the dispersion in the same manner as in Sample H.

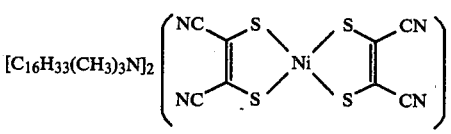

(a)

These samples were exposed to light of 1,000 lux for 1 second and then processed with the following color processing solutions.

| Developing Solution | |
|---|---|
| Benzyl Alcohol | 15 ml |
| Diethylenetriamine Pentaacetic Acid | 5 g |
| KBr | 0.4 g |
| $Na_2SO_3$ | 5 g |
| $K_2CO_3$ | 30 g |
| Hydroxylamine Sulfate | 2 g |
| 4-Amino-3-methyl-N-β-(methanesulfonamido)ethylaniline $3/2H_2SO_4.H_2O$ | 5.0 g |
| Water to make | 1,000 ml |
| | pH: 10.1 |
| **Bleach-Fixing Solution** | |
| Ammonium Thiosulfate (70 wt %) | 150 ml |
| $Na_2SO_3$ | 5 g |
| Na[Fe(EDTA)] | 40 g |
| EDTA | 4 g |
| Water to make | 1,000 ml |
| | pH: 6.8 |

| Processing | Temperature (°C.) | Time |
|---|---|---|
| Developing | 33 | 3 min 30 sec |
| Bleach-Fixing | 33 | 1 min 30 sec |
| Water Washing | 28–35 | 3 min |

Thus, Samples H, I, J and K having dye images were prepared. Samples H', I', J' and K' were prepared by subjecting corresponding samples to the same stabilization processing used in Example 1 after the above-described processing steps.

Further, Samples H'', I'', J'' and K'' were prepared by processing in the same manner with a stabilizing solution containing $Cu^{2+}$ instead of the above-described stabilization processing and washing with water.

| Composition of Stabilizing Solution Containing $Cu^{2+}$ | |
|---|---|
| $Cu(CH_3COO)_2.H_2O$ | 2.0 g |

-continued

| Composition of Stabilizing Solution Containing $Cu^{2+}$ | |
|---|---|
| Water to make | 1,000 ml |

Each sample was exposed to sunlight for 2 weeks using an ultraviolet ray absorbing filter C-40 which cut rays of less than 400 nm. The results are shown in Table III. Measurement was carried out by means of a Macbeth densitometer Type RD-514 (Status AA filter) and variation of density in an area of the sample having an initial density of 2.0 was measured to determine the dye residual ratio.

TABLE III

| Sample | Fog*1 | $D_{max}$*1 | Dye Residual Ratio*2 (%) |
|---|---|---|---|
| H | | | 26 |
| H' | 0.16 | 2.5 | 25 |
| H'' | | | 26 |
| I | | | 27 |
| I' | 0.14 | 2.5 | 88 |
| I'' | | | 80 |
| J | | | 67 |
| J' | 0.12 | 2.4 | 67 |
| J'' | | | 65 |
| K | | | Measurement not possible |
| K' | 0.10 | 0.2 | Measurement not possible |
| K'' | | | Measurement not possible |

*1Values of Fog and $D_{max}$ are those before the light fading test
*2Dye residual ratio: (density after fading/2.0) × 100(%)

It is understood from these results that the stabilization process of the present invention causes less desensitization, and that the light resistance of the dye images can be improved without adversely influencing the photographic properties. Further, deterioration of $D_{max}$ of K, K' and K'' is caused by the desensitization function of Compound (a).

EXAMPLE 4

An emulsified dispersion was prepared in a manner similar to Example 1 except that 1.4 g of Compound I-29 was employed.

Using the thus-obtained dispersion, Sample L was prepared in the same manner as in Sample H of Example 3.

Sample M was prepared in the same manner as in Sample K of Example 3 except that 2.3 g of Compound (X) (shown below) for comparison was used instead of the hydroquinone compound.

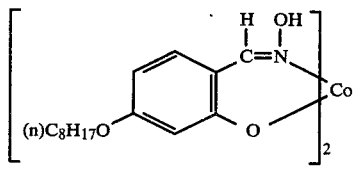

Compound (X)

These samples were exposed and then processed in the same manner as in Example 3.

After the above processing, Sample L (precursor only) and M (metal complex: Ser. No. 56,674, supra) having dye images were obtained.

By subjecting corresponding sample to the same stabilization processing used in Example 1 except for using 2.5 g of $Co(NO_3)_2.4H_2O$, Sample L' (this invention) was prepared.

Each sample was exposed to sunlight for 2 weeks using an ultraviolet ray absorbing filter C-40 which cut rays of less then 400 nm.

The results are shown in Table IV wherein measurement of a density was carried out in the same manner as in Example 3.

TABLE IV

| Sample | Fog*1 | $D_{max}$*1 | Dye Residual Ratio*2 (%) |
|---|---|---|---|
| L | 0.15 | 2.5 | 25 |
| M | 0.35 | 1.5 | 78 |
| L' | 0.15 | 2.5 | 89 |

*1,2:Same as in Table III.

It is understood from the results above that the stabilization process of this invention causes less fogging, and that the light fastness of the dye images can be improved without adversely affecting the photographic properties.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic sensitive material containing at least one compound selected from the compounds represented by the following general formulae (I), (II), (III) and (IV) and alkali metal salts, alkaline earth metal salts, borates, aluminium salts and zinc salts thereof with a solution containing divalent ions of at least one metal selected from the group consisting of copper, cobalt, nickel, palladium and platinum:

(I)

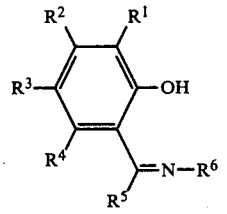

(II)

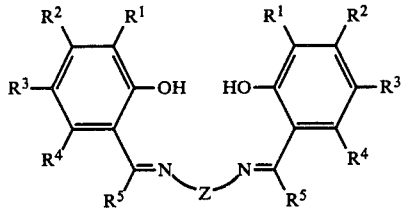

(III)

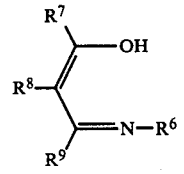

(IV)

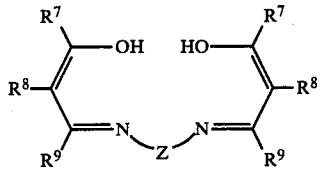

wherein the formulae (II) and (IV) include the tautomers; $R^1$, $R^2$, $R^3$ and $R^4$ each represent a hydrogen atom, a halogen atom, a cyano group, or an alkyl group, an aryl group, a cycloalkyl group or a heterocyclic group bonded to the benzene nucleus directly or through a divalent connecting group, or $R^1$ and $R^2$, $R^2$ and $R^3$ or $R^3$ and $R^4$ may combine and represent a non-metallic atomic group necessary to form a 6 member ring; $R^5$, $R^8$ and $R^9$ each represent a hydrogen atom, an alkyl group or an aryl group, $R^6$ represents a hydrogen atom, an alkyl group, an aryl group or a hydroxyl group, $R^7$ represents an alkyl group or an aryl group, or $R^7$ and $R^8$ or $R^8$ and $R^9$ may combine and represent a non-metallic atomic group necessary to form a 5 member to 8 member ring; and Z represents a divalent connecting group consisting of non-metallic atoms.

2. The process of claim 1, wherein $R^1$, $R^2$, $R^3$ and $R^4$ each represent a hydrogen atom, a halogen atom selected from the group consisting of fluorine, bromine and iodine, a cyano group, a straight chain or branched chain alkyl group having 1 to 19 carbon atoms which may be substituted or unsubstituted, an aryl group having 6 to 14 carbon atoms which may be substituted or unsubstituted, a 5-membered or 6-membered heterocyclic ring or a 5-membered or 6-membered cycloalkyl group which may be substituted or unsubstituted, said groups being bonded to the benzene nucleus directly or through a divalent connecting group, or $R^1$ and $R^2$, $R^2$ and $R^3$ or $R^3$ and $R^4$ may combine and represent a benzene ring or a condensed benzene ring, which may be substituted or unsubstituted; $R^5$, $R^8$ and $R^9$ each represent a hydrogen atom, a straight chain or branched chain alkyl group having 1 to 20 carbon atoms which may be substituted or unsubstituted, a substituted or unsubstituted aryl group having 6 to 14 carbon atoms, or a hydroxyl group, $R^7$ represents a straight chain or branched chain alkyl group having 1 to 20 carbon atoms, which may be substituted or unsubstituted, or a substituted or unsubstituted aryl group having 6 to 14 carbon atoms; or $R^7$ and $R^8$, or $R^8$ and $R^9$ may be combined to form a 5-membered to 8-membered ring and Z represents a divalent connecting group consisting of non-metallic atoms.

3. The process of claim 1, wherein Z is a connecting group selected from those represented by the formulae (a), (b), (c), (d), and (e)

(a)

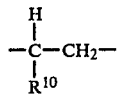

(b)

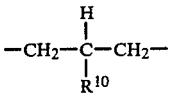

(c)

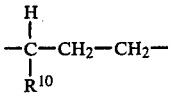

(d)

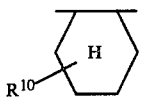

-continued (e)

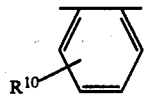

wherein $R^{10}$ represents a hydrogen atom or an alkyl group.

4. The process of claim 1, wherein said compound is a compound represented by the formulae (I) or (II) and the alkali metal salts, alkaline earth metal salts, borates, aluminum salts, and zinc salts thereof.

5. The process of claim 1, wherein said compound is represented by the following formulae (IIIa), (IIIb), and (IVa)

(IIIa)

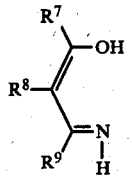

(IIIb)

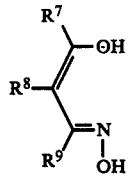

(IVa)

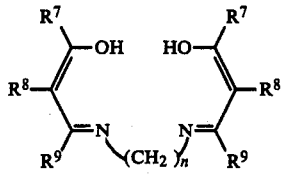

wherein $R^7$, $R^8$, and $R^9$ are defined as in claim 1 and n represents 2 or 3 and the alkali metal salts, alkaline earth metal salts, borates, aluminum salts and zinc salts thereof.

6. The process of claim 1, wherein said compound is represented by the formula (IIa)

(IIa)

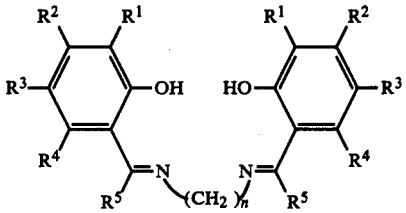

wherein $R^1$ to $R^5$ are defined as in claim 1 and n represents 2 or 3 and the alkali metal salts, alkaline earth metal salts, borates, aluminum salts and zinc salts thereof.

7. The process of claim 6, wherein said compound is a compound represented by the formulae (I) or (IIa) and the alkali metal salts, alkaline earth metal salts, borates, aluminum salts and zinc salts thereof.

8. The process of claim 1, wherein at least one of $R^1$, $R^2$, $R^3$, and $R^4$ is an alkyl group or an alkoxy group.

9. The process of claim 1, wherein the total number of carbon atoms in the groups represented by $R^1$ to $R^6$ is at least 4.

10. The process of claim 1, wherein said compound is a zinc salt.

11. The process of claim 1, wherein said compound is in the free form.

12. The process of claim 1, wherein said compound is present in a layer containing the dye image or an adjacent layer.

13. The process of claim 1, wherein said compound is present in a layer containing the dye image.

14. The process of claim 1, wherein said compound is present in said element in an amount of at least 1 micromol per square meter.

15. The process of claim 1, wherein said compound is present in an amount of about 10 to $1\times10^4$ micromols per square meter.

16. The process of claim 1, wherein said divalent metal ion-containing solution contains about 0.01 to 50 g/100 ml of a salt of said divalent metal ion.

17. The process of claim 1, wherein said processing is at a temperature of about 5° C. to 50° C.

18. The process of claim 1 wherein said processing is carried out after forming said dye image.

19. The process of claim 1, wherein said dye image is formed by the coupling reaction of a color coupler with the oxidation production of a color developing agent.

20. The process of claim 1, wherein said dye image is formed by a silver dye bleaching process.

21. The process of claim 1, wherein said dye image is formed by a diffusion transfer process.

22. The process of claim 1, wherein said color photographic sensitive material is contacted with said solution containing said divalent ions by dipping said color photographic sensitive material in said solution containing said divalent ions.

23. The process of claim 1, wherein said color photographic sensitive material is contacted with said solution containing said divalent ions by spraying said solution containing said divalent ions thereon.

24. The process of claim 1, wherein color photographic sensitive material is contacted with said solution containing said divalent ions by spreading said solution containing said divalent ions between layers of said color photographic sensitive material.

25. The process of claim 1 which further comprises image-wise exposing said color photographic sensitive material.

26. A silver halide color photographic sensitive material comprising at least one compound selected from the compounds represented by the following general formulae (I), (II), (III) and (IV) and alkali metal salts, alkaline earth metal salts, borates, aluminum salts and zinc salts (I)

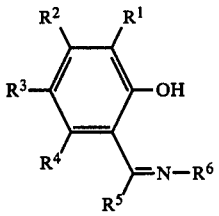

-continued (II)

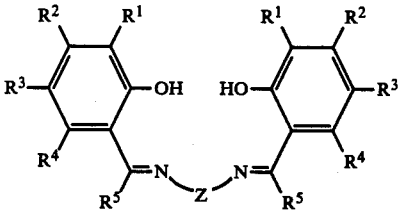

(III)

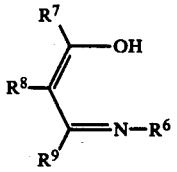

-continued (IV)

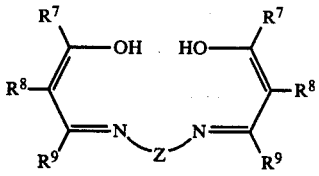

wherein the formulae (III) and (IV) include the tautomers; $R^1$, $R^2$, $R^3$ and $R^4$ each represent a hydrogen atom, a halogen atom, a cyano group, or an alkyl group, an aryl group, a cycloalkyl group or a heterocyclic group bonded to the benzene nucleus directly or through a divalent connecting group, or $R^1$ and $R^2$, $R^2$ and $R^3$ or $R^3$ and $R^4$ may combine and represent a non-metallic atomic group necessary to form a 6-member ring; $R^5$, $R^8$ and $R^9$ each represent a hydrogen atom, an alkyl group or an aryl group, $R^6$ represents a hydrogen atom, an alkyl group, an aryl group or a hydroxyl group, $R^7$ represents an alkyl group or an aryl group, or $R^7$ and $R^8$ or $R^8$ and $R^9$ may combine and represent a non-metallic atomic group necessary to form a 5-member to 8-member ring; and Z represents a divalent connecting group consisting of non-metallic atoms.

* * * * *